US006568041B2

(12) United States Patent
Camozzi

(10) Patent No.: US 6,568,041 B2
(45) Date of Patent: May 27, 2003

(54) TUBE WITH SUCTION SLOTS FOR A UNIT FOR CONDENSING A BUNDLE OF TEXTILE FIBRES DRAFTED IN A SPINNING MACHINE

(75) Inventor: Attilio Camozzi, Brescia (IT)

(73) Assignee: Marzoli S.p.A., Brescia (IT)

( * ) Notice: Subject to any disclaimer, the term of this patent is extended or adjusted under 35 U.S.C. 154(b) by 0 days.

(21) Appl. No.: 10/134,494

(22) Filed: Apr. 30, 2002

(65) Prior Publication Data

US 2002/0157218 A1 Oct. 31, 2002

(30) Foreign Application Priority Data

Apr. 30, 2001 (IT) ..... TO01U0062

(51) Int. Cl.[7] ..... D01H 5/86
(52) U.S. Cl. ..... 19/246; 19/150; 19/236
(58) Field of Search ..... 19/150, 236–250, 19/252, 263, 286–288, 304–308; 57/264, 304, 315, 328, 333; 15/301, 312.1, 314, 256.51, 256.52, 256.53

(56) References Cited

U.S. PATENT DOCUMENTS 4,953,349 A * 9/1990 Fehrer ..... 19/236
6,108,873 A * 8/2000 Barauke ..... 19/150
6,263,656 B1 * 7/2001 Barauke ..... 19/150
6,332,244 B1 12/2001 Camozzi
6,349,533 B2 * 2/2002 Camozzi ..... 19/150

FOREIGN PATENT DOCUMENTS

IT 1 106 719 A1 * 6/2001 ..... D01H/5/72

* cited by examiner

*Primary Examiner*—Gary L Welch
(74) *Attorney, Agent, or Firm*—Sughrue Mion, PLLC

(57) ABSTRACT

A condensing unit for condensing a bundle of textile fibers comprises a fixed tube of circular cross-section, which is common to several spinning stations located side by side, is connected to a suction source, and has a suction slot in each station. Filtering sleeves are mounted so as to be freely rotatable on the tube and have perforated portions which cover the corresponding slots. The tube has, in each spinning station, a recess which extends along an arc of the circumference of the tube. This recess has a pair of axially spaced-apart radial surfaces which cooperate with the sleeve in order to keep it in the correct axial position along the tube with the perforated portion over the slot.

11 Claims, 2 Drawing Sheets

TUBE WITH SUCTION SLOTS FOR A UNIT FOR CONDENSING A BUNDLE OF TEXTILE FIBRES DRAFTED IN A SPINNING MACHINE

BACKGROUND OF THE INVENTION

The present invention relates to a tube with suction slots for a unit for condensing a bundle of textile fibres drafted in a spinning machine.

The field of application of the present invention is that of spinning machines having a plurality of adjacent spinning stations in each of which there is a drafting unit associated with a condensing unit for treating a bundle of textile fibres, or roving, to be transformed into a twisted yarn.

For a better understanding of the prior art and of the problems inherent therein, a conventional condensing unit will be described first of all with reference to FIGS. 1 and 2 of the appended drawings.

In FIG. 1, a bundle of textile fibres or roving 1 is supplied to a drafting unit, generally indicated 2, comprising three pairs of rollers 3 and 4, 5 and 6, 7 and 8, which pull the roving along at increasing linear velocities in order to thin it gradually. The roving output from the drafting unit 2 then goes to a condensing unit 10 located downstream of the drafting unit, before being sent for twisting.

The condensing unit 10 comprises a lower fixed tube 11 of circular cross-section, connected to a suction source (not shown), by means of a manifold 12. As shown in FIG. 2, the tube 11, which is common to several spinning stations located side by side, has, in each station, a narrow suction slot 15 arranged on the path of and in the direction of movement of the roving.

A plurality of freely rotatable cylindrical sleeves 16 are mounted along the tube 11, there being one sleeve in the region of each spinning station and each sleeve having a central perforated portion 17 which extends around the entire circumference of the sleeve and covers the corresponding slot 15 with a large margin. Each sleeve 16 is driven so as to move around the tube 11 by a pressure roller 18 of elastomeric material which presses the roving against the perforated portion 17 of the filtering sleeve 16. The pressure roller 18 is rotated by the last pressure roller 7 of the drafting unit 2, by means of a belt transmission 19.

As shown in FIG. 2, the outer surface of the fixed tube 11 is machined to form cylindrical recesses 13 which house locating rings 9 that perform the dual functions of:

- keeping the sleeves 16 correctly positioned axially along the tube so that the central perforated portions 17 of the sleeves are located over on the respective suction slots 15, and
- limiting the area of the sliding contact surface between the sleeve 16 and the tube 11 to the narrow region of the recesses 13.

An example of this prior art is described in EP-1106719-A, which is incorporated herein by reference.

SUMMARY OF THE INVENTION

An object of the present invention is to provide a condensing unit of simple and inexpensive construction which, in particular, reduces the costs connected with the machining of the tube to render it suitable for housing the above-mentioned locating rings.

A further object of the invention is to provide a condensing unit which does not have the above-mentioned conventional locating rings.

These and other objects and advantages which will be understood further from the following description are achieved, according to the present invention, by a novel condensing unit.

BRIEF DESCRIPTION OF THE DRAWINGS

The characteristics and the advantages of the invention will become clear from the detailed description of an embodiment thereof, given with reference to the appended drawings, provided by way of non-limiting example in which.

DETAILED DESCRIPTION OF THE INVENTION

Figure 4:
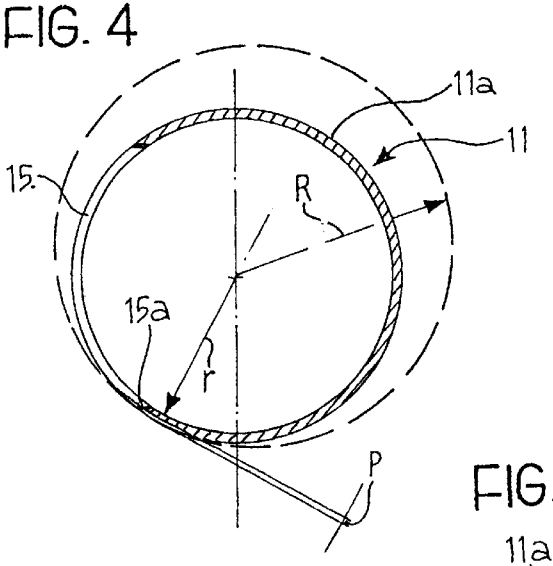
FIG. 4 is a view sectioned on the line IV—IV of FIG. 3.
Figure 3:
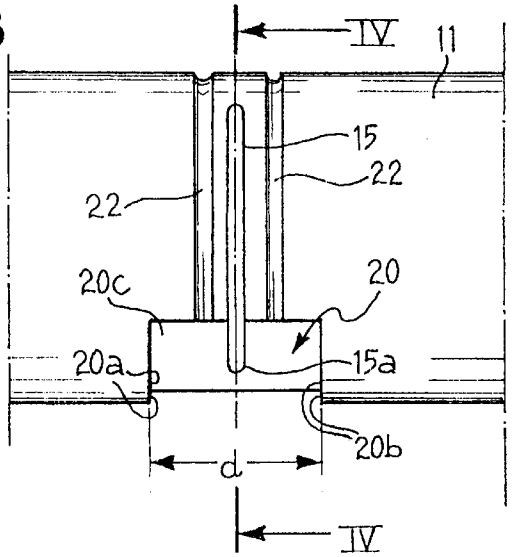
FIG. 3 is a side view of a portion of a tube with a suction slots according to the present invention.

The general structure of the tube and of the sleeve shown in FIGS. 3 and 4 can be considered generally known. Only the elements which are of specific importance and interest for the purposes of the implementation of the present invention will therefore be described in detail in the following portion of the present description. For the construction of the parts and of the elements which are not described in detail, reference may therefore be made to any condensing unit of known type.

With reference to FIGS. 3 to 6, a recess 20 formed, for example by milling, in the outer surface 11*a* of a tube 11 in the region of each spinning station, has an axial width corresponding to the width of a filtering element 16 and extends around a small circumferential arc.

Figures 1, 2:
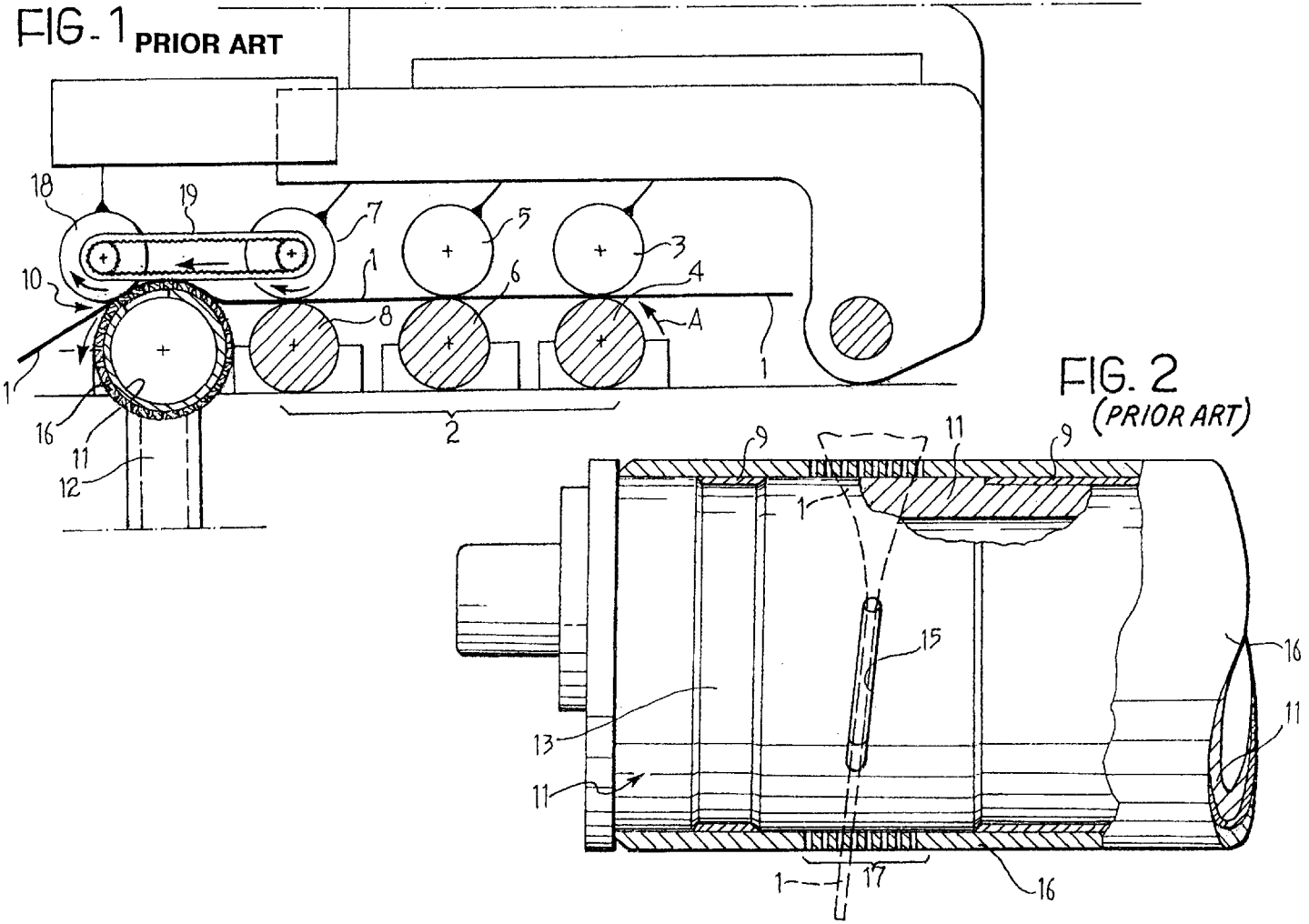
FIG. 1 PRIOR ART
FIG. 2 (PRIOR ART)
FIG. 1 is a partially-sectioned, side elevational view of a drafting unit and of a condensing unit, relating to the present invention.
FIG. 2 is a partially-sectioned side view of a condensing unit with a conventional tube and a filtering element.

As shown in FIG. 1, the pressure roller 18 which presses the bundle of fibres 1 against the perforated portion 17 of the filtering sleeve 16, acts in the region of the slot 15 and, more particularly, in the vicinity of the end 15*a* of the slot which is located downstream with reference to the direction of movement of the bundle of fibres being processed. The recess 20 is therefore preferably formed in the tube 11 in a manner such as to include the end 15*a* of the slot 15.

The recess 20 has a surface 20*c* which is substantially flat along a chordal plane, or is slightly convex with a radius of curvature "R" greater than the radius "rr" of the external cylindrical surface 11*a* of the tube 11. In the preferred embodiment shown in the drawings, the surface 20*c* is tangential to the downstream end 15*a* of the slot 15.

The recess 20 defines a pair of radial surfaces 20*a*, 20*b* which serve as shoulders for keeping the filtering sleeve 16 in the correct axial position with the perforated portion 17 located over the slot 15.

The axial width "d" of the recess 20, that is, the distance between the shoulder surfaces 20*a* and 20*b*, is therefore selected in dependence on the axial width of the filtering element to be used; the width "d" is therefore advantageously determined in a manner such that, when a filtering element 16 is mounted on the tube 11, it is housed between the shoulder surfaces 20*a*, 20*b* with a minimal axial clearance which does not hinder its movement around the tube 11.

Figure 6:
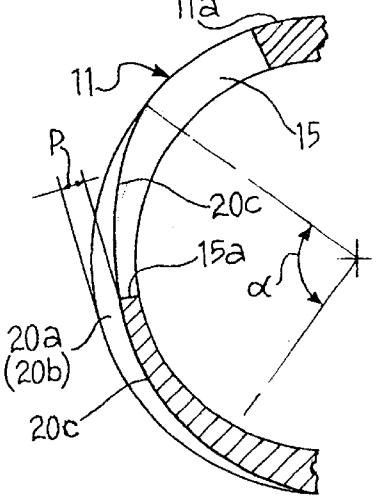
FIG. 6 is an enlarged view of a detail of the section of FIG. 4 with distorted proportions, for explanatory purposes.
Figure 5:
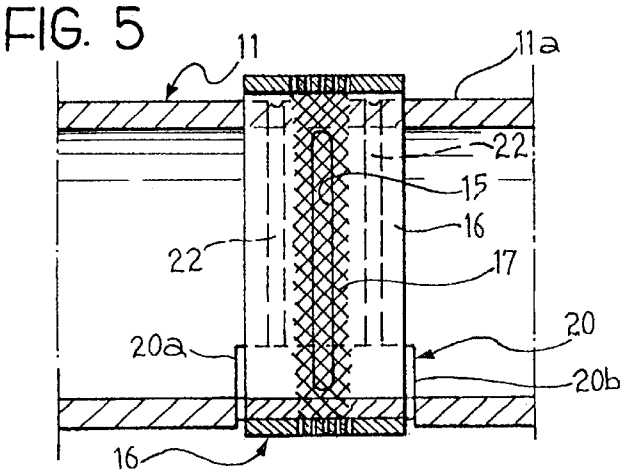
FIG. 5 is a partially-sectioned side view of the portion of tube of FIG. 3 with a filtering element in the form of a cylindrical sleeve.

With regard to the radial dimension (or depth), it should be noted that, for illustrative purposes, the correct proportions have not been adhered to in FIGS. 5 and 6. The maximum depth "p" of the recess 20, measured in the region of its centre, may even be very small, for example between 0.1 and 1 mm. The circumferential extent of the recess, which depends on its depth and on the radius of curvature of the surface 20*c* of the recess, must be determined in a manner such that the filtering element 16 (which is driven by the rubber pressure roller 18) is guided correctly in its movement around the tube 11. Good results have been obtained experimentally with recesses having an angular extent $\alpha$ of between approximately 5° and 90°.

A pair of circumferential grooves formed in the tube 11 on either side of the slot 15 are indicated 22 in FIGS. 3 and 5. Each groove 22 defines, between the tube 11 and the sleeve 16, a respective arcuate or annular chamber (according to the circumferential extent of the grooves 22) which serves to permit a circulation of air at the interface between the sleeve and the tube, to prevent or at least drastically reduce the formation of accumulations of microfibres and dirt.

Although filtering elements 16 in the form of rotating elements 16 of rigid or semi-rigid material are illustrated and described in the drawings and in the foregoing description, these filtering elements may alternatively be constituted by equivalent filtering elements in the form of endless belts, as are known, for example, from EP-1106719-A.

As will be appreciated, since the axial positioning of the filtering elements is ensured by a recess that can be produced easily and inexpensively, the conventional locating rings mentioned in the introductory portion of the description can be eliminated and the machining of the tube can be simplified.

What is claimed is:

1. A condensing unit for condensing a bundle of textile fibres coming from a drafting unit in a spinning station of a spinning machine, comprising:

a fixed tube of substantially circular cross-section, which is common to several spinning stations located side by side, is connected to a suction source, and has, in each station, a suction slot located on the path of and along the direction of movement of the bundle of fibres, a plurality of annular or cylindrical filtering elements mounted so as to be freely rotatable on the fixed tube and each having a perforated portion which covers at least a corresponding slot, each filtering element being rotated about the fixed tube by a pressure roller which presses the bundle of fibres against the perforated portion of the filtering element, wherein the tube has, at each spinning station, a recess formed in an outer surface of the tube, the recess extending along an arc of the circumference of the tube, the recess having a pair of axially spaced-apart radial surfaces adapted to cooperate with the filtering element in order to keep the filtering element correctly positioned axially along the tube with the perforated portion covering the slot.

2. The condensing unit of claim 1, wherein the recesses are formed in the tube in the region of the slots.

3. The condensing unit of claim 2, wherein the recesses are formed in the region of the ends of the slots which are located downstream, with reference to the direction of movement of the bundle of fibres.

4. The condensing unit of claim 3, wherein the recesses have a circumferential extent such as to include the downstream ends of the slots.

5. The condensing unit of claim 4, wherein each recess extends along a circumferential arc having a central point substantially coincident with the downstream end of the slot.

6. The condensing unit of claim 1, wherein each recess has a convex surface with a radius of curvature greater than the radius of the external cylindrical surface of the tube.

7. A condensing unit of claim 1, wherein the axial distance between the radial surfaces is such as to house a filtering element with slight axial clearance.

8. The condensing unit of claim 1, wherein the maximum radial depth of each recess is approximately between 0.1 and 1 mm.

9. The condensing unit of claim 1, wherein each of the recesses extends through a circumferential arc of approximately between 5° and 90°.

10. The condensing unit of claim 1, wherein the fixed tube has, in the vicinity of the slot, at least one circumferential or arcuate groove for defining a respective arcuate or annular chamber between the tube and the respective filtering element.

11. The condensing unit of claim 10, wherein the fixed tube has, at the sides of and in the vicinity of each slot, a pair of circumferential or arcuate grooves for defining respective arcuate or annular chambers between the tube and the respective filtering element.

* * * * *